US010016077B1

(12) United States Patent
Carney

(10) Patent No.: US 10,016,077 B1
(45) Date of Patent: Jul. 10, 2018

(54) BRACKET FOR WALL MOUNTING

(71) Applicant: Raymond M. Carney, Mobile, AL (US)

(72) Inventor: Raymond M. Carney, Mobile, AL (US)

( * ) Notice: Subject to any disclaimer, the term of this patent is extended or adjusted under 35 U.S.C. 154(b) by 0 days.

(21) Appl. No.: 15/632,053

(22) Filed: Jun. 23, 2017

(51) Int. Cl.

| | |
|---|---|
| ***A47G 7/02*** | (2006.01) |
| ***A47G 7/04*** | (2006.01) |
| ***F16M 13/02*** | (2006.01) |
| *A47F 7/00* | (2006.01) |

(52) U.S. Cl.
CPC ..... *A47G 7/044* (2013.01); *A47G 7/047* (2013.01); *F16M 13/02* (2013.01); *A47F 7/0078* (2013.01)

(58) Field of Classification Search
CPC ..... A47G 7/044; A47G 7/045; A47G 7/047; F16M 13/02; A47F 7/0078
USPC ..... 211/88.03, 85.23, 87.01, 86.01, 70.6; 47/39, 41.11, 70, 67, 83, 65, 65.5, 45; 248/27.8, 224.7, 224.8, 225.11, 225.21, 248/301, 303, 304, 307, 339; D6/567
See application file for complete search history.

(56) References Cited

U.S. PATENT DOCUMENTS 284,090 A * 8/1883 Tingle ..... A47F 7/283 211/103
313,667 A * 3/1885 Hesser ..... A47G 7/047 248/318
365,555 A * 6/1887 Tolman ..... A47G 7/047 211/32
448,359 A * 3/1891 Nichols ..... F16L 3/12 248/220.22
724,427 A * 4/1903 Bonsall ..... A47G 25/0657 206/292
725,678 A * 4/1903 Cullum ..... A47G 7/045 126/299 R
726,079 A * 4/1903 Lord ..... A47G 7/047 47/67
741,004 A * 10/1903 Van Nostran ..... G09F 23/00 16/223
764,307 A * 7/1904 Scahill ..... A01G 9/022 108/20
778,786 A * 12/1904 Kramer ..... A47G 7/047 215/399
796,676 A * 8/1905 Rogers ..... A47G 25/0685 211/87.01
862,841 A * 8/1907 Newport ..... D06F 57/12 108/29
D58,089 S * 6/1921 Gulick ..... 211/87.01
1,566,982 A * 12/1925 Shee ..... A47G 7/044 248/214
1,600,931 A * 9/1926 Chatham ..... A47G 7/047 248/318

(Continued)

*Primary Examiner* — Abigail E Troy
*Assistant Examiner* — Devin K Barnett
(74) *Attorney, Agent, or Firm* — George L Williamson

(57) ABSTRACT

Method and apparatus for a semi-circular bracket for holding plants or the like having a plurality of receptacles for receiving the stems of a plurality of radially extending arms or the like wherein the plant bracket has a base with planar portions thereon for use in mounting the bracket either on a wall or about a central pole by using a separate mounting plate. The semi-circular bracket has a plurality of receptacles therein configured for use with set screws to hold the ends of the arms in the receptacle so that the limbs cannot fall out of the receptacles.

8 Claims, 3 Drawing Sheets

(56) References Cited

U.S. PATENT DOCUMENTS 1,730,732 A * 10/1929 Jacobs ..... A47G 25/0664 211/107
1,794,251 A * 2/1931 Schaff ..... A47G 7/045 248/304
1,797,077 A * 3/1931 Dew ..... A47G 7/041 211/85.23
1,848,937 A * 3/1932 Coventry ..... A47G 25/0678 211/106.01
1,897,905 A * 2/1933 Johnson ..... A47G 7/041 211/85.23
2,025,707 A * 12/1935 Consolazio ..... A47G 7/044 211/88.03
2,035,639 A * 3/1936 Davis ..... B60S 5/00 211/70.6
2,278,391 A * 3/1942 Hunter ..... A47G 7/045 108/28
2,565,624 A * 8/1951 Phelon ..... A47G 21/14 211/1
2,572,797 A * 10/1951 Zimmer ..... A47J 47/16 211/70.6
2,794,554 A * 6/1957 Donner ..... A47G 7/042 211/163
2,919,881 A * 1/1960 Eames ..... A47K 10/10 211/105.1
3,015,024 A * 12/1961 Charchan ..... A01G 9/12 174/38
3,245,645 A * 4/1966 Dupler ..... A47G 25/0678 248/215
3,530,996 A * 9/1970 Schaffer ..... A47F 5/13 211/107
3,620,174 A * 11/1971 Dentino ..... A47B 13/08 108/151
3,861,630 A * 1/1975 Ady ..... B65L 367/125 248/100
3,894,707 A * 7/1975 Heard ..... F16B 2/08 248/225.11
3,978,612 A * 9/1976 Young ..... A47G 7/045 211/96
4,071,976 A * 2/1978 Chernewski ..... A47G 7/044 248/312.1
4,190,221 A * 2/1980 Updike ..... F16M 13/00 248/222.41
4,372,450 A * 2/1983 Licari ..... A47G 25/0678 211/106.01
4,524,542 A * 6/1985 Elliott ..... A47G 7/045 47/67
4,609,173 A * 9/1986 Belokin ..... A47K 10/12 211/105.1
4,757,641 A * 7/1988 Penrod ..... A47G 7/044 248/27.8
4,770,303 A * 9/1988 Boyd ..... A47G 7/042 211/118
4,801,123 A * 1/1989 Lynch ..... A47G 33/12 248/150
4,887,785 A * 12/1989 Blaich ..... A01K 39/00 24/716
4,991,344 A * 2/1991 Carney ..... A47G 7/042 211/133.2
5,037,049 A * 8/1991 Funk ..... A47F 5/01 248/165
5,201,430 A * 4/1993 Artzer ..... A47G 21/14 206/370
5,203,462 A * 4/1993 Brooks ..... A47F 5/08 211/14
5,433,413 A * 7/1995 Adams ..... A47G 1/17 248/205.3
5,487,517 A * 1/1996 Smith ..... A47G 7/044 248/215
5,873,195 A * 2/1999 Wortham ..... A47G 7/042 211/207
D411,066 S * 6/1999 Romeo ..... D6/567
D412,804 S * 8/1999 Romeo ..... D6/567
D413,206 S * 8/1999 Magnusson ..... D6/320
D413,471 S * 9/1999 Romeo ..... D6/567
6,216,886 B1 * 4/2001 Considine ..... A47F 5/06 211/196
6,250,481 B1 * 6/2001 Chang ..... A47K 1/09 211/119.009
6,254,052 B1 * 7/2001 Hubbard ..... F24H 9/06 248/225.11
D447,358 S * 9/2001 Cavero ..... D6/403
6,843,022 B1 * 1/2005 Holley ..... A47G 7/041 47/39
7,024,816 B1 * 4/2006 Marks ..... A47G 7/044 47/39
D549,004 S * 8/2007 Rief ..... D6/681.2
7,458,475 B2 12/2008 Ho
8,511,468 B2 * 8/2013 Reeves ..... A61B 50/20 206/370
8,511,485 B2 * 8/2013 Hernandez ..... A47F 5/0838 211/106.01
2001/0037599 A1 * 11/2001 McIntyre ..... A47G 7/041 47/67
2003/0038135 A1 * 2/2003 Zhu ..... A47G 7/044 220/489
2003/0116688 A1 * 6/2003 Furukawa ..... A47F 5/0006 248/339
2003/0189144 A1 * 10/2003 Byrne ..... A47G 7/045 248/226.11
2005/0028443 A1 * 2/2005 Hartman ..... A47G 7/047 47/67
2005/0035250 A1 * 2/2005 Schoneboom ..... A47G 7/045 248/217.2
2005/0082244 A1 * 4/2005 Ho ..... A47G 7/041 211/85.23
2005/0194332 A1 * 9/2005 Berfield ..... A47L 9/0063 211/70.6
2006/0112633 A1 * 6/2006 Humphrey ..... A47G 7/041 47/66.6
2007/0084975 A1 * 4/2007 Steiger ..... A47G 7/042 248/27.8
2007/0175842 A1 * 8/2007 Shieh ..... A47K 10/10 211/88.04
2007/0246628 A1 * 10/2007 Palmer ..... A47G 7/045 248/304
2009/0056216 A1 * 3/2009 Falk ..... A47G 7/042 47/67
2010/0058659 A1 * 3/2010 Zweber ..... A01G 27/008 47/67
2010/0078541 A1 * 4/2010 Fathi ..... A44B 15/005 248/339
2011/0041398 A1 * 2/2011 Armas ..... A47G 7/044 47/39
2012/0144654 A1 * 6/2012 Christian ..... A47G 7/045 29/525.08
2012/0181403 A1 * 7/2012 Lee ..... A47G 7/044 248/225.21
2012/0240458 A1 * 9/2012 Ganske ..... A47G 7/041 47/39
2012/0318942 A1 * 12/2012 Merker ..... A47G 7/044 248/219.4
2014/0110555 A1 * 4/2014 Maddux ..... A47F 5/06 248/558
2014/0283449 A1 * 9/2014 Rapone ..... A47G 7/044 47/67
2017/0114952 A1 * 4/2017 Green ..... F16M 13/022

* cited by examiner

BRACKET FOR WALL MOUNTING

BACKGROUND OF THE INVENTION

Field of the Invention

The present invention relates generally to brackets for displaying articles and, more particularly, is concerned with a semi-circular shaped bracket for holding potted plants for mounting on a wall or similar structure.

Description of the Related Art

Devices relevant to the present invention have been described in the related art, however, none of the related art devices disclose the unique features of the present invention.

In U.S. Pat. No. 4,770,303 dated Sep. 13, 1988, Boyd disclosed a demountable stand for supporting hanging plants. In U.S. Pat. No. 7,458,475 dated Dec. 2, 2008, Ho disclosed a modular tree-like structure for holding potted plants. In U.S. Pat. No. 4,991,344 dated Feb. 12, 1991, Carney disclosed an apparatus for holding plants, pots or the like. In U.S. Pat. No. 5,037,049 dated Aug. 6, 1991, Funk disclosed a foldable, tree-like structure for hanging plants. In U.S. Patent Application Publication No. 2009/0056216 dated Mar. 5, 2009, Falk disclosed a stand for plants or the like.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a semi-circular bracket for holding plants or the like having a plurality of receptacles for receiving the stems of a plurality of radially extending arms or the like wherein the plant bracket has a base with planar portions thereon for use in mounting the bracket either on a wall or about a central pole by using a separate mounting plate. The present invention also includes a plurality of radially extending arms having curled like ends for hanging potted plants thereon along with a plurality of circular pot rings within which rings a flower pot could be placed. The semi-circular bracket has a plurality of receptacles therein configured for use with set screws to hold the ends of the arms in the receptacle so that the limbs cannot fall out of the receptacles. Additionally, a mounting plate is shown for use in conjunction with fasteners wherein the wall bracket can be attached to an upright standing pole or the like.

An object of the present invention is to hang radially extending arms or limbs thereon upon which potted plants can be placed. A further object of the present invention is to provide a wall bracket for receiving a plurality of radially extending arms therein. A further object of the present invention is to provide a wall bracket which can be used to hang radially extending arms onto the wall of a structure such as a building. A further object of the present invention is to provide a wall bracket that can be used in conjunction with set screws to firmly attach the radially extending arms therein. A further object of the present invention is to provide a wall bracket that can be easily operated by a user.

A further object of the present invention is to provide a wall bracket which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
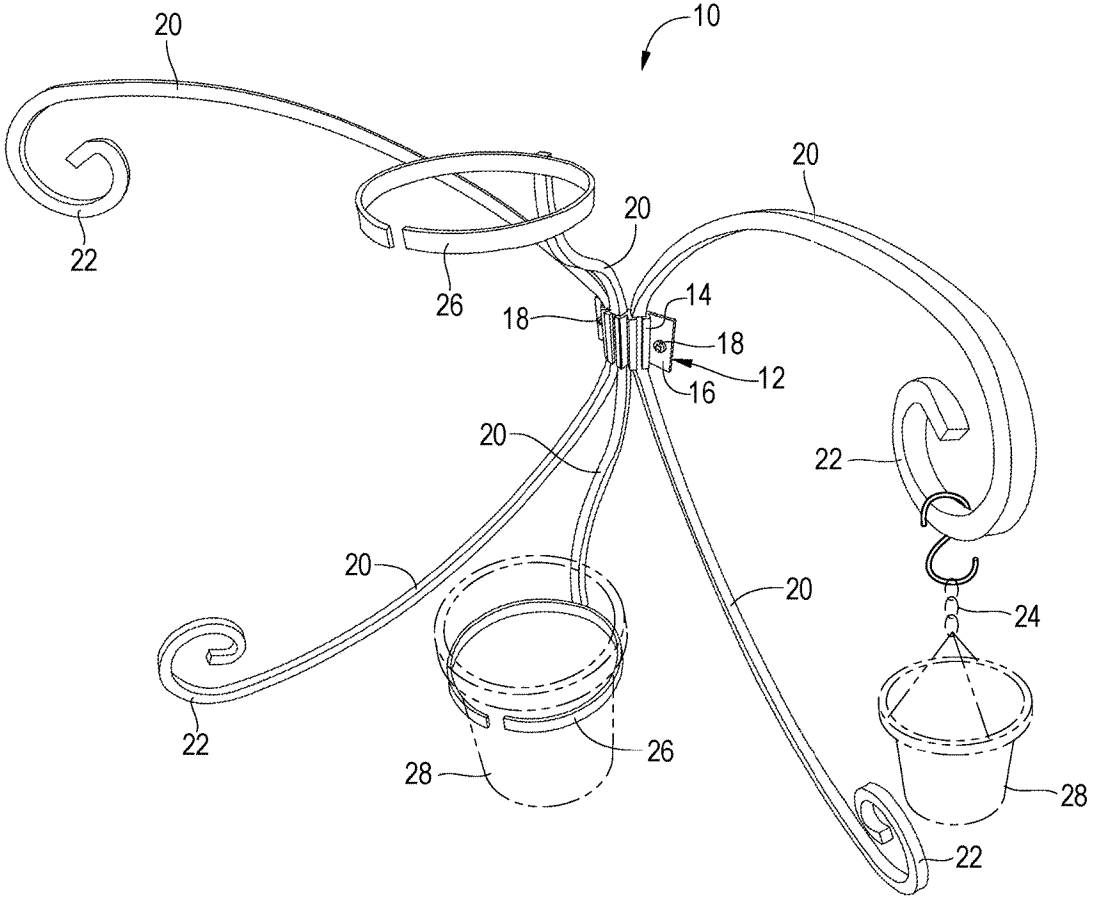
FIG. 1 is a perspective view of the present invention.

With regard to reference numerals used, the following numbering is used throughout the drawings.

10 present invention
12 wall bracket
14 receptacle
16 base plate
18 fastener
20 radially extending limbs/arms
22 curled end
24 plant chain
26 circular ring
28 pot for plant
30 set screw
32 base of limbs/arms
34 aperture
36 pole
38 mounting plate
40 section of wall
42 planar section
44 opening
46 head of fastener
48 aperture
50 semi-circular cutout
52 hex set screw

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a wall bracket for hanging plants is disclosed and which is generally indicated by reference number 10.

Figure 2:
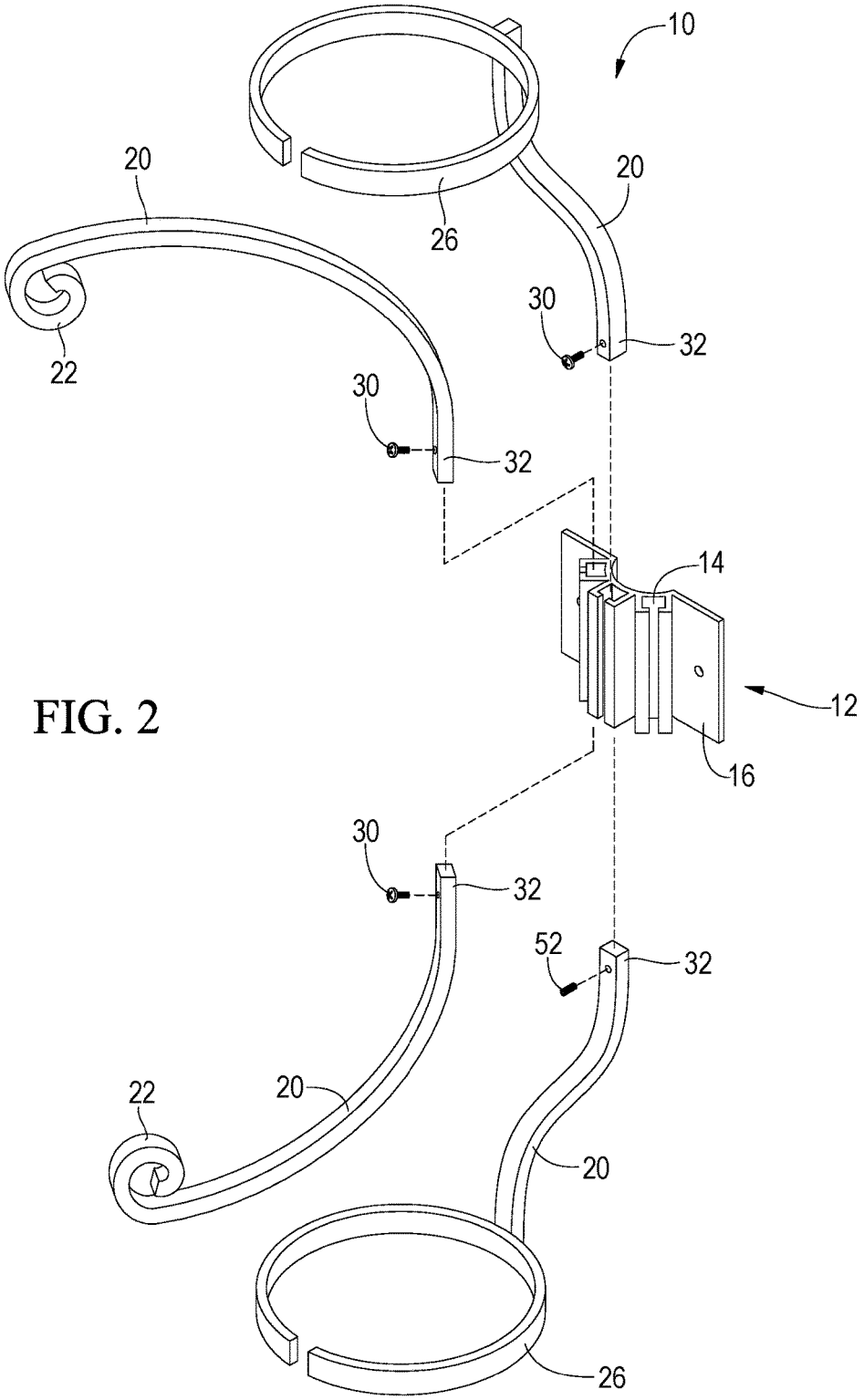
FIG. 2 is an exploded view of the present invention.

Turning to FIGS. 1 and 2, therein is shown the present invention 10 including a wall bracket 12 having a plurality of receptacles or sockets 14 wherein the bracket has a base plate 16 along with fasteners 18 for attaching the base plate to a structure. Also shown is a plurality of limbs or arms 20 wherein some arms are of a type with a curled end 22 therein upon which pots with plants 28 can be hung using chains 24 with hooks or the like along with at least one type arm with a circular ring 26 for receiving a pot 28 therein which pot can contain flowers. Also shown in FIG. 2 are a plurality of set screws 30 for use in attaching the base 32 of the limbs into the receptacles 14 so as to secure the radially extending limb or arm 20 into its respective receptacle 14. It can be seen that each set screw 30 goes through an aperture 34 which is expected to be threaded. The bases 32 may be placed in the receptacles 14 from above or below the receptacles and held in place by the set screws 30, 52.

Figure 3:
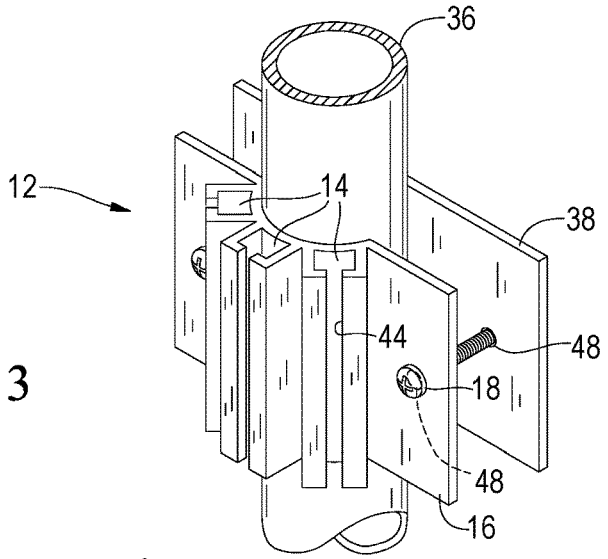
FIG. 3 is a perspective view of the present invention shown mounted on a pole.

Turing to FIG. 3, therein is shown the wall bracket 12 mounted onto an upstanding pole 36 or the like wherein the bracket 12 is attached to the pole using a mounting plate 38 wherein the fastener 18 passes through apertures 48 in both the mounting bracket and the mounting plate so as to attach the bracket 12 about the pole 36. Also shown is the base plate 16. Alternatively, pole 36 could also be replaced by any square or rectangular shaped upright member such as a fence picket.

Figure 4:
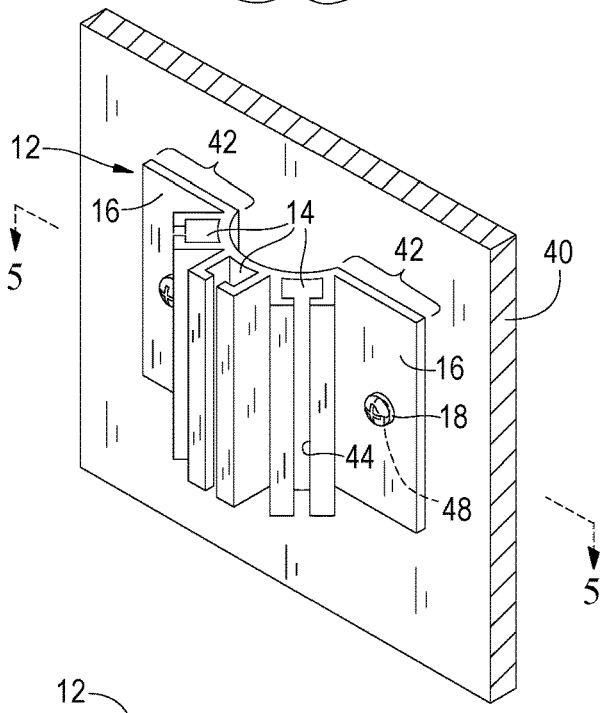
FIG. 4 is a perspective view of the present invention shown attached to a section of a wall.

Turning to FIG. 4, therein is shown the mounting bracket 12 being easily attachable to a wall section 40 largely due to a planar or flat section 42 built into the base plate 16 of the mounting bracket 12 so that the planar section is flush with and therefore conforms with the section of the wall 40 and wherein fasteners 18 are used to attach the bracket to the wall section by having the fasteners pass through apertures 48 in the mounting bracket. This is a major advantage of the present invention 10 in that the mounting bracket is attachable to a section of a wall 40.

Figure 5:
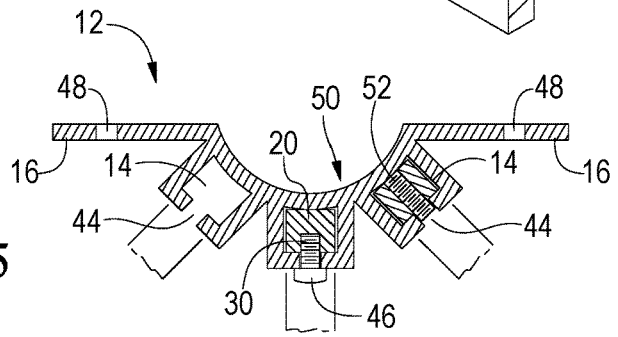
FIG. 5 is a cross-sectional view of the present invention taken from FIG. 4 as indicated.

Turning to FIG. 5, therein is shown the wall bracket 12 showing an opening 44 on the front of each square-shaped socket or receptacle 14 which is provided to allow the set screw 30 to pass through the opening to be screwed into the radially extending limbs/arms 20 so as to attach the limb securely in the receptacle of the present invention 10. Also shown is the head 46 of the set screw. An alternative screw 52 is also shown being a hex socket set screw (allen screw) not having a head thereon. Also shown are apertures 48 in the planar section 40 of the present invention 10 which allows fasteners 18 (not shown) to be passed through the present invention as has been previously described. Also shown is a semi-circular or cutout area 50 of the bracket 12 which is provided to allow the bracket to receive a pole therein so as to be attached to a pole as previously disclosed. The semi-circular area 50 provides additional length between planar areas 42 for accommodating a plurality of receptacles 14. The set screws 30 are provided so that is the limbs 20 are placed into the sockets 14 from the bottom they will not fall out when bumped. Conventional brackets have allowed for limbs 20 to be placed in the bottoms of their sockets 14 from below so that a cantilever effect caused by gravity held the limbs in place, however, if the limbs were bumped the limbs could fall out of the sockets due to their weight pulling them downwardly which is a major disadvantage of the prior art. However, the present invention 10 overcomes this problem by securing the limbs 20 inside the receptacles 14 by using a set screw 30, 52 thereby preventing the limbs from falling out of the receptacles in any situation. Note that opening 44 is sized and shaped to receive the threaded portion of the set screw 30 therein while the outer surface also provides a rest for the head portion 46 of the fasteners. Alternatively, the set screw 52 can extend completely through the limb 20 so that the screw tip bears against the surface/wall of the semi-circular cut-out 50 so as to secure the limb inside the receptacle 14.

A summary of the present invention 10 is provided and may make reference to FIGS. 1-5 wherein a bracket 12 for supporting potted plants 28 is disclosed, the bracket being usable for mounting on a wall 40 including the bracket having a semi-circular portion 50 and first and second planar portions 42; a plurality of integrally formed receptacles 14 on the semi-circular portion, the receptacles being capable of receiving the bases of radially extending arms 20 and disposing the semi-circular portion between the first and second planar portions; and, configuring the first and second planar portions for mounting the bracket on the wall. Also, providing openings 44 on the receptacles, wherein the openings are vertically disposed on a front of the bracket. Also, configuring the radially extending arms to receive set screws 30, 52 or the like for securing the arms in the receptacles. Also, passing the set screws through the openings and into the radially extending arms. Also, sizing the openings to provide a stop for a head 46 of the set screw as the set screw secures the arm in the receptacle. Also, extending the receptacles from the top to the bottom of the receptacles and wherein the receptacles are square shaped. Also, disposing the first and second planar surfaces opposite each other about 180 degrees apart on a periphery of the semi-circular portion and wherein the bracket 12 is rectangular shaped.

I claim:

1. A method for mounting a bracket for supporting potted plants, comprising the steps of:

a) providing a plurality of curved limbs;

b) providing the bracket, the bracket having a semi-circular portion and first and second planar portions extending outwardly from ends of said semi-circular portion;

c) providing a plurality of spaced pairs of parallel walls extending radially outward from an outer surface of said semi-circular portion, each corresponding pair of parallel walls forms a receptacle therebetween, the receptacles receive said limbs between the corresponding pairs of parallel walls, each pair of parallel walls having inwardly directed flange portions extending perpendicular from distal ends thereof to define opposing L-shaped walls, wherein an opening is defined between distal ends of each pair of inwardly directed flange portions to partially enclose a corresponding limb in each of said receptacles; and d) mounting the first and second planar portions of the bracket on a wall or pole;

e) inserting a threaded set screw through each said opening between said inwardly directed flange portions of each pair of parallel walls and threading each set screw into a corresponding limb to secure the limbs in the receptacles.

2. The method of claim 1, wherein the openings extend vertically along a front of the bracket.

3. The method of claim 2, wherein the distal ends of said inwardly directed flange portions of said pairs of parallel walls provide a stop for a head of each set screw when a corresponding set screw secures the corresponding limbs in each receptacle respectively.

4. The method of claim 3, further comprising the steps of positioning the pole along an inner surface of said semicircular portion, attaching said first and second planar portions to a mounting plate on an opposite side of said pole.

5. The method of claim 1, wherein the receptacles are generally square shaped.

6. The method of claim 1, further comprising the step of disposing the first and second planar portions opposite each other about 180 degrees apart on a periphery of the semicircular portion.

7. The method of claim 1, wherein the first and second planar portions of said bracket are generally rectangular shaped.

8. The method of claim 1, further comprising the steps of forming the first and second planar portions to be flush with the wall.

* * * * *